US009929521B2

(12) United States Patent
Aida et al.

(10) Patent No.: US 9,929,521 B2
(45) Date of Patent: Mar. 27, 2018

(54) WRAPPED ELECTRICAL CABLE

(71) Applicant: Dark Energy, LLC, Provo, UT (US)

(72) Inventors: Garrett Aida, Provo, UT (US); Nial Spencer, Pleasant Grove, UT (US)

( * ) Notice: Subject to any disclaimer, the term of this patent is extended or adjusted under 35 U.S.C. 154(b) by 0 days.

(21) Appl. No.: 15/290,707

(22) Filed: Oct. 11, 2016

(65) Prior Publication Data

US 2017/0104302 A1 Apr. 13, 2017

Related U.S. Application Data

(60) Provisional application No. 62/240,390, filed on Oct. 12, 2015.

(51) Int. Cl.

| | |
|---|---|
| ***H01R 13/58*** | (2006.01) |
| ***H01R 24/62*** | (2011.01) |
| ***H01R 24/68*** | (2011.01) |
| ***H01R 13/717*** | (2006.01) |
| *H01R 107/00* | (2006.01) |

(52) U.S. Cl.

CPC ..... *H01R 24/62* (2013.01); *H01R 13/7175* (2013.01); *H01R 24/68* (2013.01); *H01R 2107/00* (2013.01)

(58) Field of Classification Search

CPC ..... H01R 13/58; H01R 24/62; H01R 24/68; H01R 24/64; H01R 13/7175; H01R 210/007

USPC ..... 439/676, 660, 623, 445, 607.31

See application file for complete search history.

(56) References Cited

U.S. PATENT DOCUMENTS 4,569,420 A * 2/1986 Pickett ..... F16N 7/38 184/15.1
6,242,689 B1 * 6/2001 Budge ..... H01B 11/12 174/27
6,713,673 B2 * 3/2004 Kao ..... H01B 11/12 174/113 C
6,733,333 B1 * 5/2004 Chen ..... H01R 13/6658 439/552
7,094,970 B2 * 8/2006 Kihira ..... B60L 11/1803 174/74 R
7,247,795 B2 * 7/2007 Sumi ..... H01R 24/562 174/74 R
2003/0000728 A1 * 1/2003 Buck ..... H01B 7/0892 174/113 R
2003/0221850 A1 * 12/2003 Mizutani ..... H01R 13/6592 174/36

(Continued)

OTHER PUBLICATIONS

Paracord survival bracelet sold on Etsy.com, URL: <https://www.etsy.com/listing/259392693/seahawks-fishtail-paracord-bracelet?ref=shop_home_active_15>. Accessed Oct. 10, 2016.

(Continued)

*Primary Examiner* — Harshad C Patel

(74) *Attorney, Agent, or Firm* — Durham Jones & Pinegar; Sarah W. Matthews; Randall B. Bateman

(57) ABSTRACT

A wrapped electrical cable, such as a charging cable, is disclosed which is more rugged than standard electrical cables. The electrical cable includes plug heads with a hole therethrough for receiving a cable, and a cable extending from the hole through one plug head to the hole through the opposing plug head. The cable and cord may be further wrapped in a sheath of cord, such as paracord. The cord may have connectors on either end, allowing a user to loop the cord for carrying and/or storage and/or hooking the cord to a load, or daisy chain multiple cords together to lengthen the cord. The plug heads and/or caps may be formed at least partly of transparent material and include one or more light sources/ The plug heads may also include two or more connector types in a single plug head.

17 Claims, 11 Drawing Sheets

(56) References Cited

U.S. PATENT DOCUMENTS

| | | | | |
|---|---|---|---|---|
| 2004/0042735 | A1* | 3/2004 | Ma | H01R 13/6641 385/88 |
| 2005/0124209 | A1* | 6/2005 | Currie | H01R 13/7172 439/490 |
| 2011/0155458 | A1* | 6/2011 | Kato | B60R 16/0215 174/74 R |
| 2014/0106590 | A1* | 4/2014 | Wu | H01R 27/00 439/284 |
| 2015/0270667 | A1* | 9/2015 | Lee | G06F 3/03545 439/577 |

OTHER PUBLICATIONS

Retractable Charcing Cable sold by 4Imprint, URL: <https://www.4imprint.com/search/retractable%20charging%20cable/product/128014/Retractable-Charging-Cable>, Accessed Oct. 11, 2016.

Paracord survival Flint and Steel bracelet sold on Etsy.com, URL: <https://www.etsy.com/listing/276333884/purple-survival-bracelet-womens-purple?ref=shop_home_active_23>. Accessed Oct. 10, 2016.

Paracord wrapped lightning cable sold by Paracable, URL: <https://paracable.com/collections/lightning-cables/products/continuum-lightning-cable>. Accessed Oct. 10, 2016.

Lightning charger paracord wrapped bracelet sold on Etsy.com, URL: <https://www.etsy.com/listing/450910108/iphone-lightning-samsung-micro-charger?ref=shop_home_active_1>. Accessed Oct. 10, 2016.

Multicable with adaptor sold on markertek.com, URL: <http://www.markertek.com/product/sim-suo100/sima-suo-100-usb-multi-cable-with-a-and-b-adapter-ends>. Accessed Oct. 11, 2016.

Lightning cable with micro-USB adaptor sold by KSIX, URL: <http://www.ksixmobile.com/en/ksix-lightning-cable-2-in-1-charge-and-sync-micro-usb-cable-with-lightning-adaptor-2022.1003>. Accessed Oct. 11, 2016.

* cited by examiner

WRAPPED ELECTRICAL CABLE

BACKGROUND OF THE INVENTION

1. The Field of the Invention

The present invention relates to improved electrical cables. More specifically, the present invention relates to an electrical cable that is wrapped to protect the cable and increase its utility.

2. State of the Art

Electrical cables, such as charging cables used to charge cell phones, tablets, PDAs, laptops, etc., are becoming increasingly common as the use of electronic devices increases. One problem often experienced with these electrical cables is that the cables are designed to be removed by pulling the plug head out of the port or socket. Because the plug head is rather small, it may be difficult to grasp. Thus, users may pull the plug head out of the port or socket by pulling on the cable, rather than on the plug head. However, pulling the cable in this manner causes the cable to break over time.

Another problem with standard charging and electrical cables may be that the cables experience concentrated forces at the plug head and cable intersection. Often, this intersection experiences torsional stresses from twisting, and compressive and tensile stresses from bending the cable back sharply at the intersection. Due to the concentration of forces, cables often first break at the intersection of the cable and the plug head.

Cables wrapped in paracord are known in the art. While the paracord wrapping may provide some protection to the electrical cable, it does not allow a user to use the paracord wrapped around the cable without first removing the paracord wrap.

Thus, there is a need for a new electrical cable that can reduce the forces at the intersection of the plug head and cable, and provide additional protection and functionality for the electrical cable.

SUMMARY OF THE INVENTION

According to one aspect of the present disclosure, a wrapped electrical cable is described. The electrical cable may be wrapped with any suitable material, and in some implementations, the electrical cable may be wrapped in paracord.

According to another aspect, an electrical cable is provided with plug heads that are larger in size. In some implementations, the plug heads include a hole therethrough for receiving a length of material, such as paracord.

According to yet another aspect, an electrical cable is provided with a length of material that is connected to both plug heads of the electrical cable, the length of material being constant and approximately the same length or slightly shorter than the length of the electrical cable. Additional wrapping material may be used as a sheath to cover the length of material and the electrical cable.

According to another aspect, the length of material that extends along the electrical cable may be provided with a loop and/or connector at both ends of the material. For example, a loop may be provided at one end and a carabiner at the other end, or carabiners at both ends. In this manner, the length of material may ready to carry a load. It may also allow the ends to be connected to form a bracelet, etc., when the electrical cable is not in use. It may further allow a user to chain more than one cable together for additional length. In some implementations, additional wrapping material may be used as a sheath to cover the length of material and the electrical cable. This additional wrapping material may be unwoven in case of an emergency.

According to another aspect, the plug heads may be provided with caps. The caps may include attachment members in order to connect one cap to another cap, either to form a loop or to chain cables together. The attachment members may also be directly connected to a load.

According to another aspect, the plug heads may be attached to attachment members, such as by use of a pin joint. The pin joint may allow the attachment members to rotate out of the way when a user desires to access the plug head. The attachment members may allow one end of the cable to be attached either to the other end to form a loop, or to another cable to chain multiple cables together, or directly to a load.

According to another aspect, the plug heads may be at least partly formed of a transparent material and include one or more light sources within the plug head. The caps may also be partly formed of transparent material, and/or include a light source.

In some implementations, a plug head may be provided with two or more types of connectors within a single plug head. The connectors may be moved upwardly for use or downwardly into the plug head for storage and protection.

While the present disclosure identifies numerous aspects which may be included in the wrapped electrical cable described herein, it will be appreciated that some or all of these aspects may not be necessary to practice other aspects of the present disclosure and may therefore be omitted. The scope of the invention is intended to be measured by the appended claims.

BRIEF DESCRIPTION OF THE DRAWINGS

Various embodiments of the present invention are shown and described in reference to the numbered drawings wherein.

Figure 1:
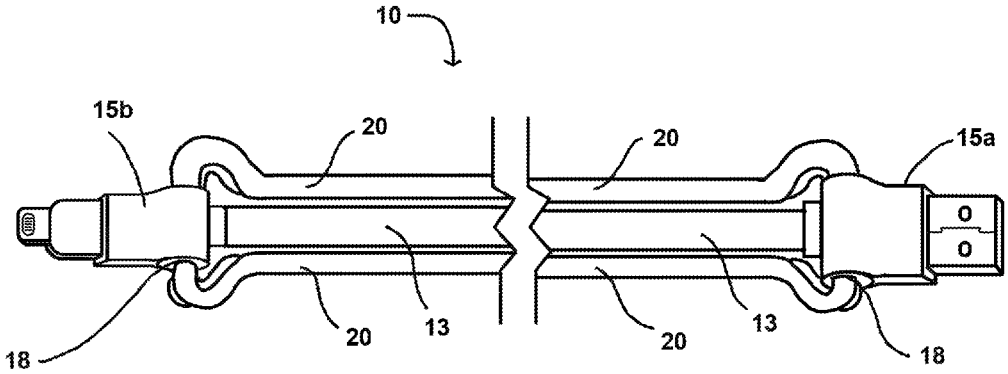
FIG. 1 shows a perspective view of wrapped electrical cable according to one implementation described herein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention and elements described herein should not be read into the claims except as specifically discussed therein.

DETAILED DESCRIPTION

The following description includes various representative embodiments and specific details in order to provide a thorough understanding of the present disclosure. The skilled artisan will understand, however, that the methods and devices described below can be practiced without employing these specific details, or that they can be used for purposes other than those described herein. Indeed, they can be modified and can be used in conjunction with products and techniques known to those of skill in the art in light of the present disclosure.

Reference in the specification to "one implementation," "one embodiment" "one aspect" or "a implementation," "an embodiment" or "an aspect" means that a particular feature, structure, or characteristic described in connection with the implementation may be included in at least one implementation and not that any particular implementation is required to have a particular feature, structure or characteristic described herein. The appearances of the phrase "in one embodiment" or similar phrases in various places in the specification are not necessarily all referring to the same implementation, and may not necessarily limit the inclusion of a particular element of the invention to a single implementation, rather the element may be included in other or all implementations discussed herein. Thus it will be appreciated that the claims are not intended to be limited by the representative implementations shown herein. Rather, the various representative implementations are simply provided to help one of ordinary skill in the art to practice the inventive concepts claimed herein.

The invention and accompanying drawings will now be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Furthermore, the described features, structures, or characteristics of implementations of the invention may be combined in any suitable manner in one or more implementations. In the following description, numerous specific details are provided, such as examples of products or manufacturing techniques that may be used, to provide a thorough understanding of implementations of the invention. One skilled in the relevant art will recognize, however, that implementations or embodiments of the present disclosure may be practiced without one or more of the specific details, or with other methods, components, materials, and so forth. In other instances, well-known structures, materials, or operations are not shown or described in detail to avoid obscuring aspects of the invention.

Prior to discussing particular implementations, it should be understood that the present invention is not limited to any particular structures, process steps, or materials discussed or disclosed herein, but is extended to include equivalents thereof as would be recognized by those of ordinary skill in the relevant art. More specifically, the invention is defined by the terms set forth in the claims. It should also be understood that terminology contained herein is used for the purpose of describing particular aspects of the invention only and is not intended to limit the invention to the aspects or implementations shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a plug head" or "a cable" may include one or more of such plug heads or cables, and reference to "the charging cord" may include reference to one or more of such charging cords.

As used herein, the term "substantially" refers to the complete or nearly complete extent or degree of an action, characteristic, property, state, structure, item, or result to function as indicated. For example, a length of material that is "substantially" the same length as the length of a cable would mean that the length of material is either exactly the same length or nearly exactly the same length. The exact allowable degree of deviation from absolute completeness may in some cases depend on the specific context. For example, a woven sheath which "substantially covers a length of cord and cable" would either completely cover the length of cord and cable or so nearly completely cover the length of cord and cable that the effect would be effectively the same. The use of "substantially" is equally applicable when used in a negative connotation to refer to the complete or near complete lack of an action, characteristic, property, state, structure, item, or result.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

As described herein, reference is made to various electrical cables for conducting electricity, such as those used to charge cell phones, PDAs, tablets, laptops, etc. It should be understood that the invention described herein may be used with any type electrical cable, such as extension cables, standard electrical cables, etc. Additionally, as described here, electrical cables are often referred to as having two plug heads. However, any type of cable, such as a cable with one head (like a USB port) on one end and a plurality of heads on the other end (like a lightning connector, a micro USB, an Apple 30-pin, a PSP, a DSI, an NDS Lite, etc.) may be used in accordance with the principles described herein. The invention described herein is not limited to a specific type of electrical cable.

As used here, "electrical cable" refers to an electrical cable comprised of two plug heads connected by a length of cable. The length of cable varies based on the intended use for the electrical cable, and "electrical cable" broadly covers any suitable length of cable connecting any two types of plug heads. The plug heads may be the same type or different types. For example, the plug heads may be lightning-type connectors, USB, micro-USB, standard home electrical socket connectors, a cigarette lighter-type connector, a 30-pin connector, etc.

As used here, wrapping material is often referred to as paracord. Paracord is a standard lightweight nylon kern-mantle rope that is used popularly used as a general purpose utility cord. It is commonly used by hikers, hunters, survivalists, etc. because it is lightweight and strong. While paracord is one possible wrapping material and referred to often in the present disclosure, it will be appreciated that numerous other types of materials are possible and contemplated herein. Thus, "paracord" or "cord" as used herein means any string, thread, twine, rope, or cord that is suitable, such as one that is flexible with tensile and compressive strength. A stronger cord material may be used to run the length of the electrical cable, and then wrapped in paracord, as described below. For example, the stronger cord material may be ropes or cord made from materials such as Kevlar, steel, polyester, nylon, polypropylene, polydacron, hemp, etc.

Turning now to FIG. 1, there is shown a perspective view of an electrical cable according to one implementation described herein. The electrical cable is generally comprised of a length of cable 13 (the length of cable varies based on the intended use for the electrical cable) extending between at least two plug heads 15*a,b*, and a length of cord 20 connected to the two plug heads that runs along the length of the cable. The two plug heads 15*a,b* each have a hole or void 18 therethrough for anchoring the length of cord to the plug heads. The length of cord may be around the same length as the length of the cable, for reasons described below. The length of cord 20 may pass once along the length of cable, or it may pass more than once (for example, twice, as shown in FIG. 1) along the length of the cable.

Turning now to the plug heads, 15*a,b*, the plug heads may be larger than plug heads known in the prior art. This may make it easier for a user to remove the plug from a socket by the plug head, thus extending the life of the electrical cable. The enlarged plug head may also allow for a hole to be formed through the plug head, or, in other words, the plug head may define a void 18 therethrough. This hole or void formed in the plug head may allow a length of cord to be threaded through the plug head and thus anchored to the plug head. It will be appreciated the plug head may define one void, or it may define two or more voids therethrough. The plug heads may include any suitable type of connector known in the art. For example, the plug head 15*a* may include a USB-type connector, while the plug head 15*b* may include a lightning 8-pin connector, a 30-pin connector, a micro-USB connector, etc.

In some implementations, a length of cord is threaded through at least one plug head, then extends along the length of the cable. It may be threaded through a second plug head. This cord that runs along the length of the cable may allow the cable to carry a load, as described below, because the length of cord is constant. The length of cord may be attached to one or more plug heads by any suitable means. For example, the length of cord may be threaded through a void in one or more plug heads, wrapped around one or more plug heads, glued with epoxy or other adhesives to one or more plug heads, or any other known method may be used to connect or anchor the length of cord to one or more plug heads. In some implementations, the cord may be placed into the plastic injection molding tool and fused into the plastic during manufacturing. In other implementations, the paracord may be stapled to the plug head, the paracord may be tied in a knot or have a ball tied to it just larger than the hole in the plug head, the paracord may be tied to the middle of a small rod, etc. One with skill in the art will appreciate that there are many known ways in the art that could be used to attach cord to the plug head.

Figure 2:
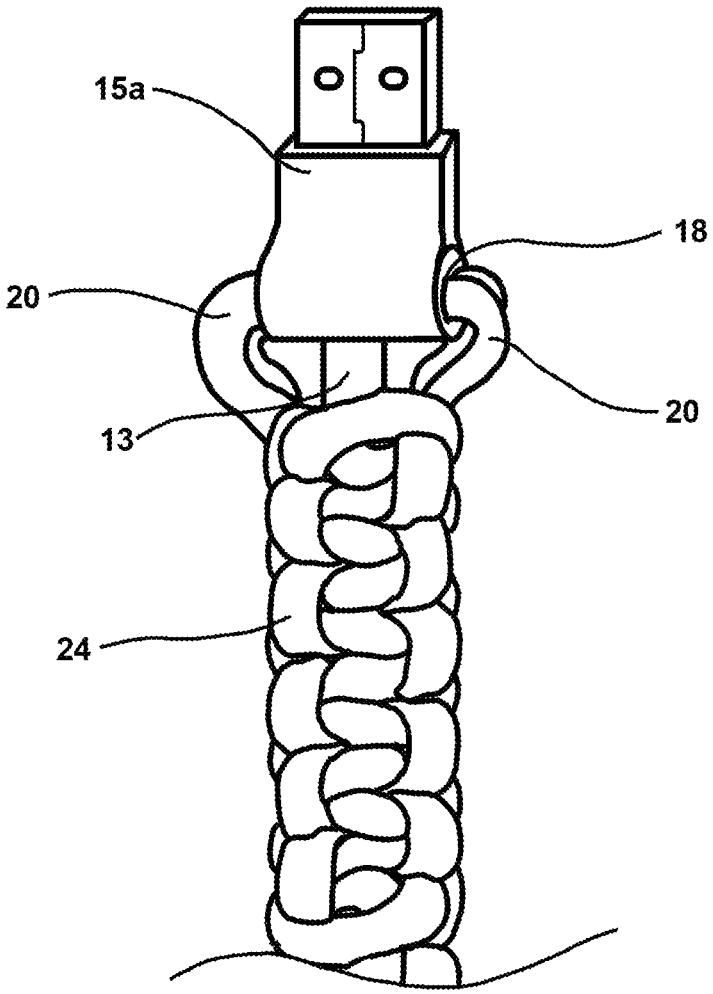
FIG. 2 shows a perspective view of one end of another implementation of a wrapped electrical cable described herein.

As can be seen in FIG. 2, the electrical cable may include a plug head 15*a* defining a void 18 therethrough, the length of cord going through the plug heads, and a woven sheath 24 around the cable and the length of cord. This woven sheath 24 may be comprised of paracord or any other suitable cord. The woven sheath 24 may generally cover the length of the electrical cable 13 and the length of paracord 20 (not visible in FIG. 2). In some implementations, the length of paracord 20 may be interwoven into the woven sheath 24 one or more times to help anchor it to the sheath.

Figure 3:
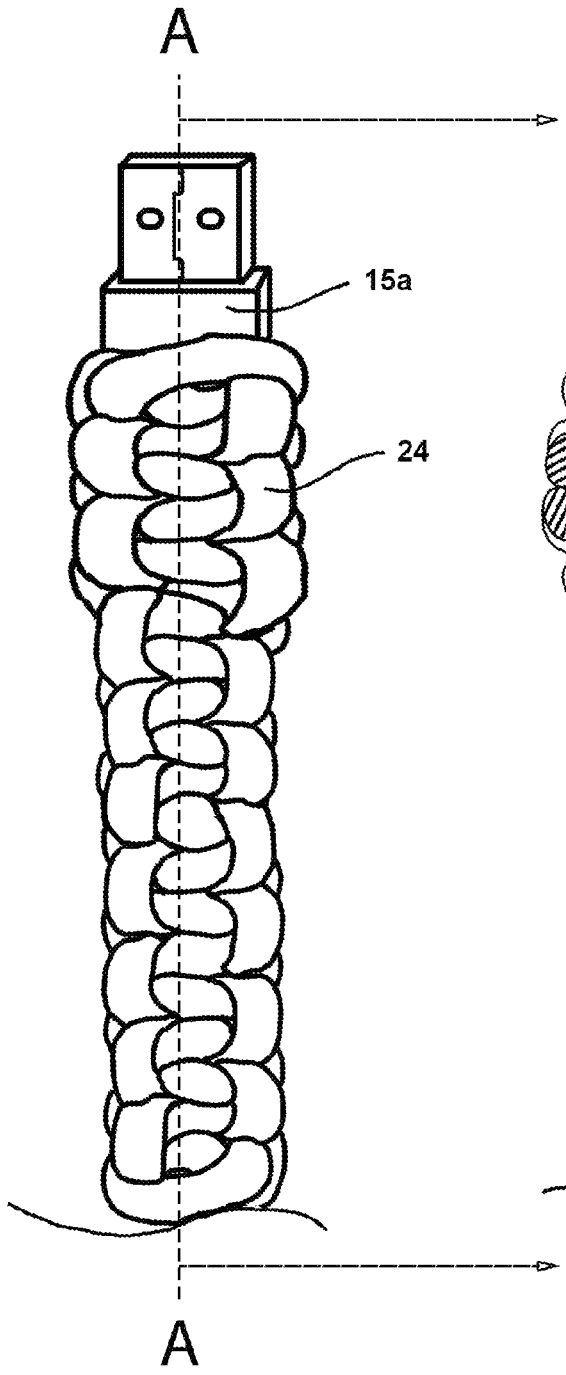
FIG. 3 shows a perspective view of one end of another implementation of a wrapped electrical cable described herein.
Figure 4:
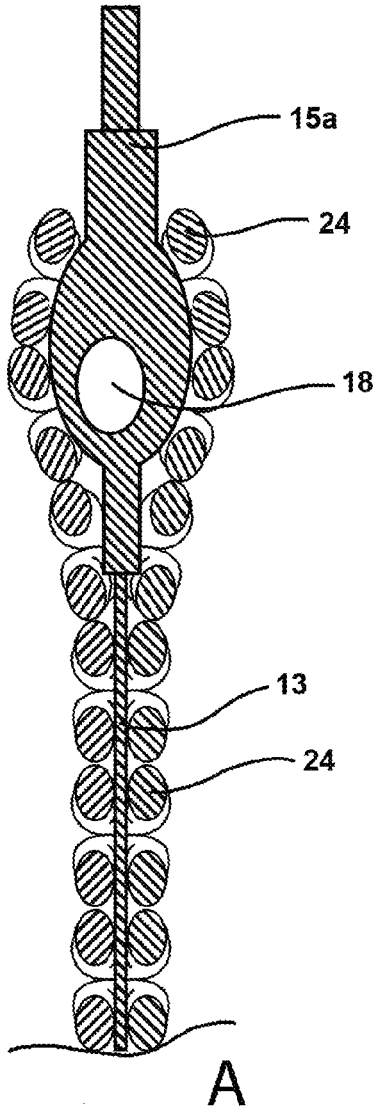
FIG. 4 shows a side, cut-away view of the end of the wrapped electrical cable shown in FIG. 3.

In the implementation shown in FIG. 3, the woven sheath 24 also covers a portion of the plug head 15*a*, providing additional protection to the plug head 15*a*. FIG. 4 shows a side, cut-away view of the wrapped cable of FIG. 3. As can be seen in this view, the woven sheath 24 extends over the plug head 15*a*. This paracord sheath over the plug head may provide additional protection and decrease mechanical failure at the plug head and cable body intersection. FIG. 4 also more clearly shows the void 18 defined by the plug head 15*a* for a length of cord, such as paracord, to pass through to anchor the cord to the plug head.

One benefit of an electrical cable that includes a constant length of cord, such as paracord may be that it has additional functionality and may be used to carry a load, whereas an electrical cable without any paracord may be too weak to carry a load and attempts to carry a load may result in the electrical cable breaking. An electrical cable that merely has a woven sheath of paracord cannot be loaded because woven paracord will stretch when it is loaded. In other words, woven paracord does not have a constant length, and will lengthen when a load is placed on it and place pressure on the plug heads. Depending on the type of weave, the length of the woven paracord may have significant stretch, such that a load pulling the woven paracord will significantly increase the length. Because the woven sheath's length is limited by the plug heads at either end of the electrical cable, the stretching of the woven sheath places pressure on the plug heads. Often, the junction between the cable and the plug head of an electrical cable is rather weak, and putting pressure on the plug heads in this manner can cause damage to the cable.

However, by providing a straight or constant length of cord, such as paracord, of approximately the same length as the length of cable, a load may be placed on the length of cord without compromising the integrity of the cable. A length of cord with a constant length may prevent the electrical cable from ever being loaded or experiencing stress, because the load will be confined to the length of cord and not transferred to the electrical cable. One with skill in the art will appreciate that a single length of cord could be provided, or multiple lengths of cord could be provided to increase the loading capacity (for example, FIG. 1 includes two lengths of cord 20, running along either side of the length of cable 13).

The length of straight or non-woven cord may be attached to the electrical cable by numerous ways. For example, the length of straight cord may be placed underneath a woven sheath of paracord. Another example may be to thread the length of straight cord through the hole or void in one or more plug heads. By threading the length of straight cord through one or more plug heads, the straight length of cord may be directly attached to the plug head. A load may be connected to this straight length of cord or cable. As stated above, because it has a constant length, when a load is placed on this length or paracord, its length will not significantly change and it will not transfer pressure or stress to the intersection of the cable and the plug head, as a woven sheath of paracord would. This length of cord or cable may be paracord, for example, or may be another stronger type of cable.

Another advantage provided by having a straight or constant length of paracord or cable that is directly connected to the plug head (such as by being threaded through a hole in the plug head) may be that it may distribute the force to the plug head when a user pulls the cable to remove the plug head from a port. The proper way to remove a plug head from a port is by grasping the plug head and pulling. However, many people simply pull on the cable between the plug heads to remove the plug, damaging the electrical cable over time. With a length of cord that runs along the length of cable and is connected to the plug head, pulling on the length of cable may also pull on the length of cord to distribute the force directly to the plug head. In this manner, the length of cord may act as a pseudo-finger and pull directly on the plug head to remove it from the port. Thus, pulling on the cable actually pulls directly on the plug head. This may save stress to the electrical cable and extend the useful life of the electrical cable.

Another possible advantage of providing a wrapped electrical cable that is connected to a plug head may be that it increases the bend radius of the cable at the plug head. Electrical cables known in the art undergo concentrated forces at the intersection of the plug head and the cable, usually torsional stresses from twisting and/or compressive and tensile stresses from bending the cable back sharply at the plug head and electrical cable intersection. The effects of this can be seen in electrical cables as they usually first break at the intersection of the plug head and the cable. The smaller the bend radius at the intersection of the cable and the plug head, the more flexible the cable is at the intersection and the higher the stress.

A woven cord that is directly connected to the plug head increases the bend radius at the intersection between the cord and the plug head. In other words, the cable is not as flexible at the intersection because the woven cord around the cable may decrease its flexibility. The increased radius may reduce concentrated stresses at the intersection and extend the life of the electrical cable.

There are numerous ways in which a wrapped electrical cable as described herein may be connected to either a load, or to another end of a cable. For example, it may be desirable to connect an electrical cable to another electrical cable, or chain multiple cables together, to extend the length of the cable that may pull a load. It also may be desirable to connect one end a wrapped cable to the other end of the same cable, to form a loop, for simple and neat storage of the cable when it is not in use. Such a loop may also be worn as a bracelet or necklace.

The wrapped electrical cable may be connected by many means, including by connecting the ends of the length of paracord, by connecting the plug heads, by connecting caps provided for the plug heads, or by connecting a combination of the ends of the paracord, plug heads, and/or plug caps, as explained in detail below.

Figure 5:
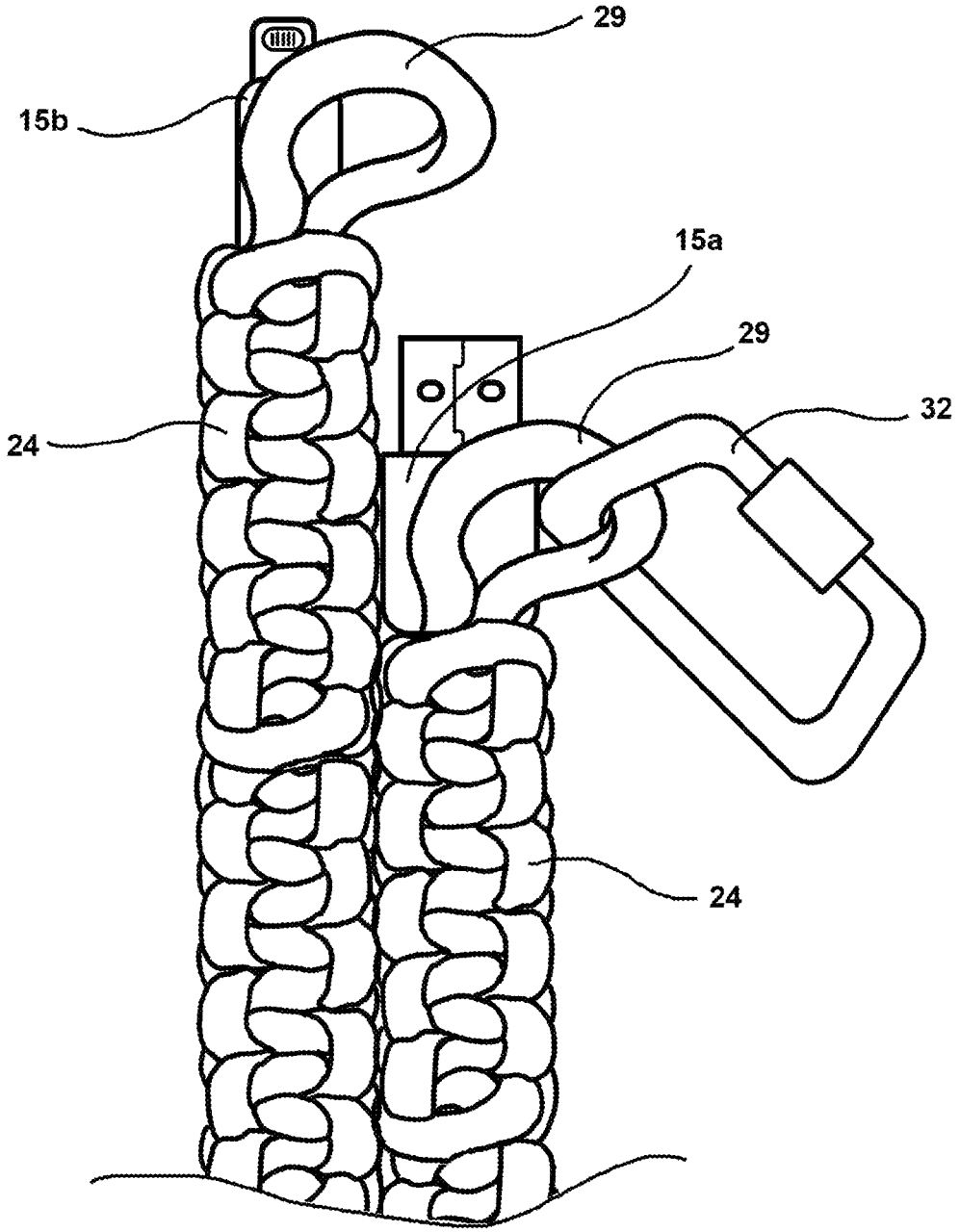
FIG. 5 shows a perspective view of the ends of another possible implementation of a wrapped electrical cable described herein.

In one implementation, shown in FIG. 5, the means for connecting one end of a wrapped electrical cable to another end may be formed on either end of the constant length of cord 20. One end of the length of cord may include an attachment member, and the other end may include a complementary attachment member. For example, one end of the length of paracord 20 may have a loop formed of paracord or other material (see loop 29 in FIG. 5). The other end of the length of paracord 20 may be provided with any suitable attachment member connected, such as a carabiner (see carabiner 32 in FIG. 5), a key chain, an extra length of cord that can be tied to the loop, etc. Similarly, one end of paracord may have an extra length of cord attached and the other end may also have an extra length of cord attached such that the extra lengths of cord may be tied together. Any known method in the art may be used to connect the two ends of the length of paracord, such as a hole and a hook or ball, a latch, a clasp, one or more carabiners, etc. With such a connection, the plug heads 15*a,b* are left free, and when a user desires to use the plug head, any connection mechanism can be rotated or otherwise pushed out of the way to leave the plug head free to use.

By having connecting means on the ends of the length of paracord, the cord may be connected to a large load and immediately used to carry it. (In contrast to other paracord wrapped cords known in the art, which are not capable of carrying a load without first unraveling the paracord.) In other implementations, rather than connecting the two ends of the length of paracord, the plug heads may be connected or caps on the plug heads may be connected.

Figure 6:
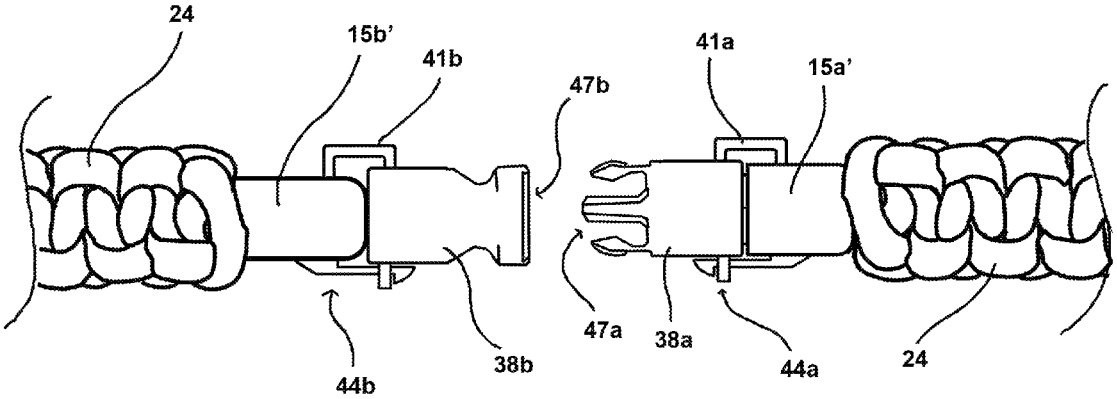
FIG. 6 shows a perspective view of the ends of another possible implementation of a wrapped electrical cable described herein with removable caps over the plug heads.

In one implementation, shown in FIG. 6, the means for connecting one end of a wrapped electrical cable to another end may be formed by caps 38*a,b* which cover the plug heads. Caps may provide additional protection to the plug heads, and to the electrical connections when not in use. The caps 38*a,b* may be provided with tabs 41*a,b* that hold the caps onto the plug heads 15*a',b'* when the caps are removed from the plug heads. This may help to prevent losing the caps when they are not in place over the plug heads. The caps 38*a,b* may also be provided with locking mechanisms 44*a,b*. The locking mechanisms may be any suitable locking mechanism known in the art, and may be a locking mechanism that prevents unlocking when the cap is being pulled or under a load. For example, in FIG. 6, the locking mechanism 44*a,b* includes a clip with an outward protrusion and a slot for receiving the clip. When the cap experiences a load, the outward protrusion engages the slot. However, when a load is not experienced, the outward protrusion may be pushed inwardly and through the slot to release the cap.

The caps 38*a,b* may also include complementary attachment members, such as complementary sides of a side release buckle 47*a,b*. When not using the electrical cable for electrical purposes such as charging, etc., a user may attach the caps 38*a,b* to the plug heads 15*a',b'*. Furthermore, a user may attach the ends of the caps together via the attachment members 47*a,b*. In this manner, the electrical cable may be kept neat and orderly when not in use, with the plug heads protected. A user may also connect one or more of the caps to a cap of another electrical cable, to chain two or more cables together. The one or more caps may also be directly connected to a load for pulling.

Figure 7:
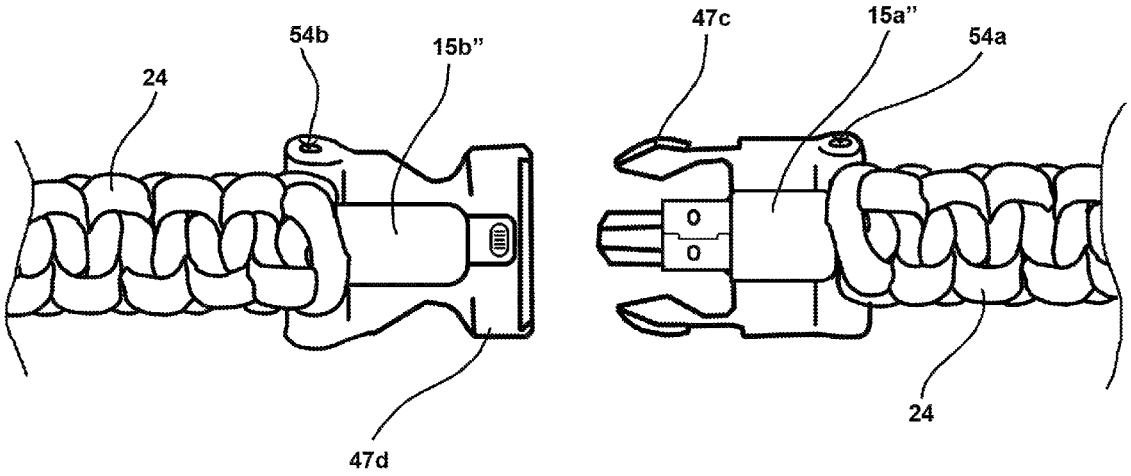
FIG. 7 shows a perspective view of the ends of another possible implementation of a wrapped electrical cable described herein with attachment members pivotally attached to the plug heads.

In another implementation, shown in FIG. 7, the means for connecting one end of a wrapped electrical cable to another end (either the end of the same cable to form a loop or the end of another cable or a load) may be formed integrally with the plug heads. In FIG. 7, the plug heads 15*a*" and 15*b*" may be connected to an attachment member 47*c,d* via a pin joint 54*a,b*. The connection via a pin joint 54*a,b* allows the attachment members 47*c,d* to rotate with respect to the plug heads, 15*a",b*". Thus, when a user desires to access the plug heads 15*a",b*", the attachment members 47*c,d* may be rotated away from the plug heads 15*a",b*" so the plug heads are free to use. The length of paracord may be attached to the plug head, as in other implementations. The attachment of the length of paracord to the plug head, which is attached to the complementary attachment members 47*c,d* may allow the attachment members to be connected to a load and the length of paracord to carry the load.

Figure 8:
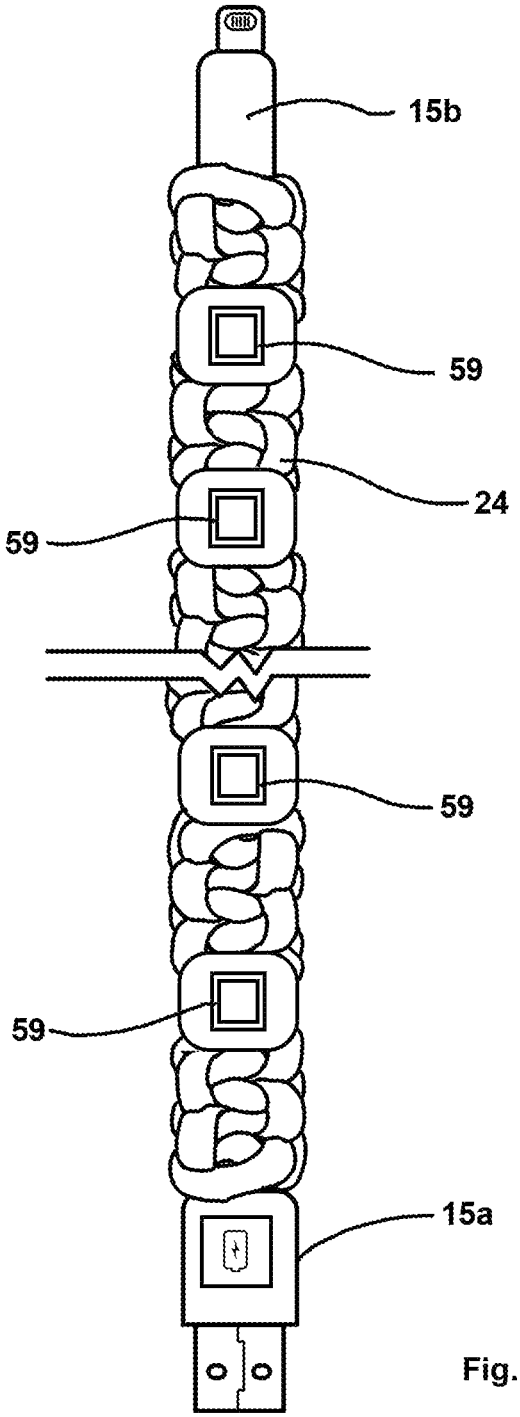
FIG. 8 shows a perspective view of another possible implementation of a wrapped electrical cable including LEDs.

According to the principles disclosed here, the present invention is not limited in scope to wrapped electrical cables. One with skill in the art will appreciate that many devices may benefit from having a paracord-wrapped sheath around the device or a section of the device to add functionality and provide protection. Nearly any section of a device that is flexible may include a paracord woven sheath according to the principles described herein. Moreover, additional functionality may be added to the paracord sheath. For example, as shown in FIG. 8, one or more LEDs 59 may be woven or attached to the paracord sheath 24. Similarly, an electrical cable may be provided that has different contact points to which a user may attach numerous different electrical devices such as lights, sensors, buttons, indicators, etc.

Figure 9:
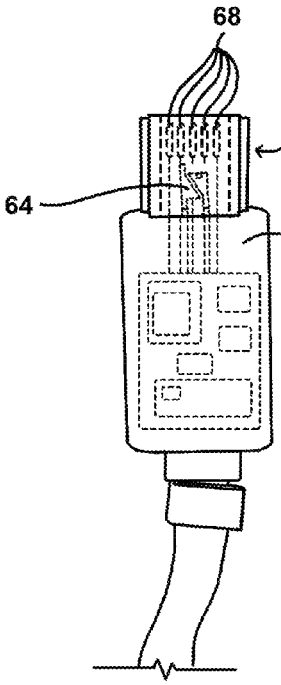
FIG. 9 shows a perspective view of a plug head with a micro-USB type connector formed at least partly of transparent material and comprising a light source.
Figure 10:
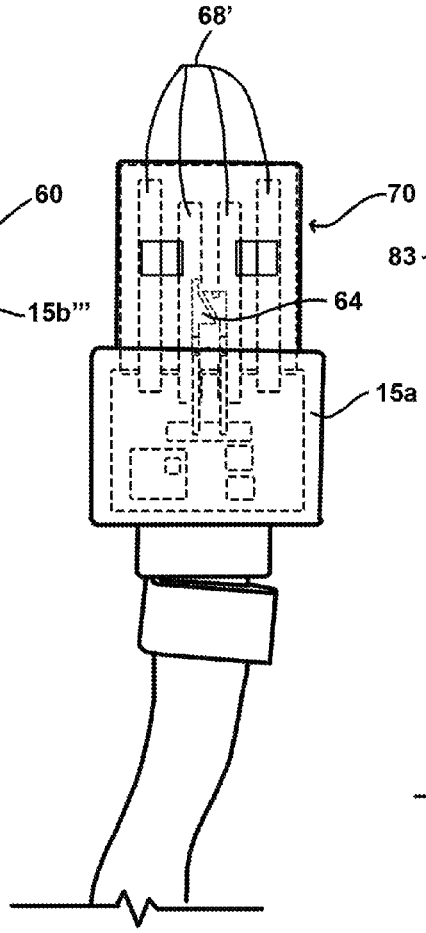
FIG. 10 shows a perspective view of a plug head with a USB type connector formed at least partly of transparent material and comprising a light source.
Figure 11:
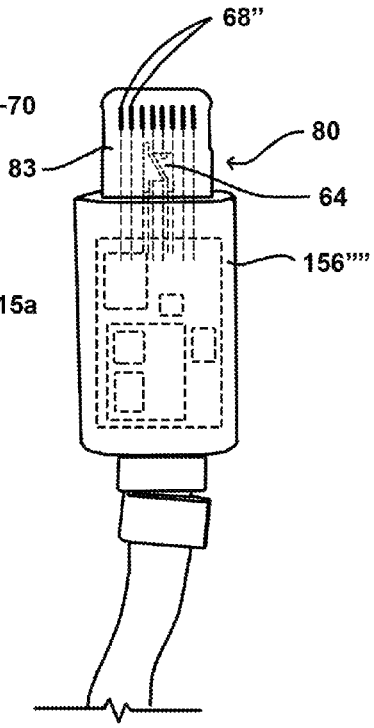
FIG. 11 shows a perspective view of a plug head with a lightning-type connector formed at least partly of transparent material and comprising a light source.

According to another implementation, the plug heads may be provided with a light source. FIGS. 9-11 shown plug heads provided with a light source. FIG. 9 shows a plug head 15*b*'" that is a micro-USB type connector 60. The micro-USB connector 60 may be at least partly formed of an optically transparent material that allows transmission of light waves therethrough. Thus, the structure of the connector 60, including any sheath or base for the electrical pins 68, may be formed of a transparent material, with the electrical pins 68 of the connector formed of an electrically conductive material. The connector 60 may also have a light source 64 within the optically transparent material. The light source 64 may be, for example, one or more light-emitting diodes.

Turning now to FIG. 10, there is shown a plug head 15*a* with a USB-type connector 70. The USB-connector, including any sheath or supporting structure, may be formed of an optically transparent material, with the electrical pins 68' formed of an electrically conductive material. Traditionally, the sheath of a plug head is formed of metal, with the supporting structure for the pins formed of a hard, opaque plastic in a variety of colors. By forming the sheath and/or supporting structure of the connector of an optically transparent material, any light placed therein may be amplified or transmitted by the connector.

FIG. 11 shows another type of plug head with a light source. According to FIG. 11, there is shown a plug head 15*b*"" with a lightning-pin type connector 80. The connector 80 includes a tongue portion 83, on which the electrical pins 68" are placed. The connector 80 may be formed at least partly of a transparent material, with a light source 64 formed integrally to the connector 80. The light source may be, for example, a light-emitting diode or other suitable light source. The light source may be electrically connected to the plug head, such that when the plug head receives power, the light source receives power. The light source may also be provided with an independent power source, such as a battery, and may optionally include an on/off switch.

Figure 12:
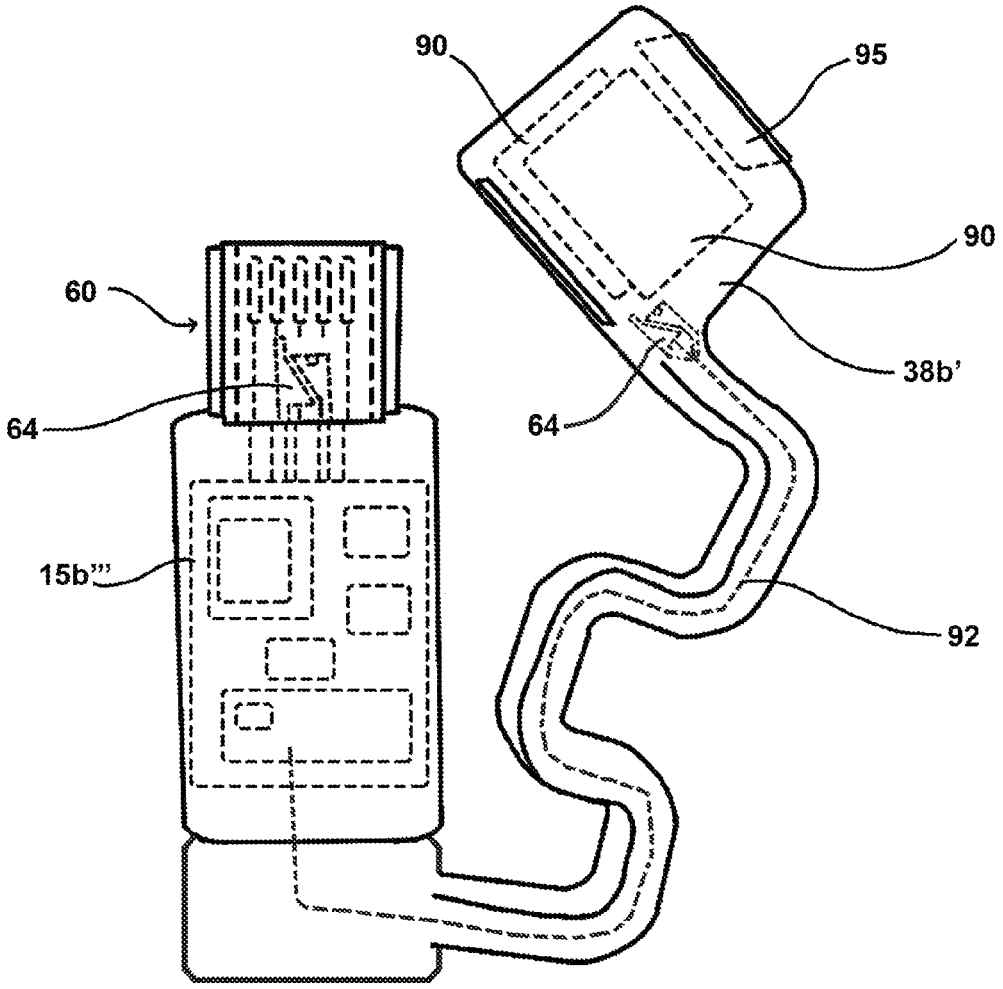
FIG. 12 shows a perspective view of one implementation of a cap that is formed at least partly of transparent material.

According to another implementation, the illuminated plug heads may be provided with a cap that also allows for dispersion and/or concentration of light. FIG. 12 shows a plug head, 15*b*'" with a micro-USB type connector 60 (such as the plug head shown in FIG. 9). The plug head 15*b*'" may be provided with a cap, 38*b*'. The cap may be generally formed of any suitable material, and in some implementations, may be at least partly formed of a transparent material. For example, the side portions of the cap may include at least a portion of transparent material 90. This transparent material may allow the light provided by the light source 64 within the connector 60 to be dispersed. Similarly, the top of the cap 38*b*' may include at least a portion of transparent material, and/or a lens 95. A lens may allow, for example, focusing or concentration of the light source 64 within the connector 60. The cap 38*b*' may also itself include a light source 64. The light source 64 may be powered by a battery, for example. In other implementations, the light source 64 may be powered by circuitry 92 connected to the plug head 15*b*'".

In this manner, the cap 38' may provide the functionality of protecting the plug head, and emitting, dispersing, and/or concentrating light. In some implementations, the cap 38 and the plug head 15 may close by frictional closure as known in the art, or may close by magnetic closure. For example, the cap may be provided with a magnet, and the plug head may be provided with an opposing magnet, such that the plug head magnet and the cap magnet attract.

Figure 13:
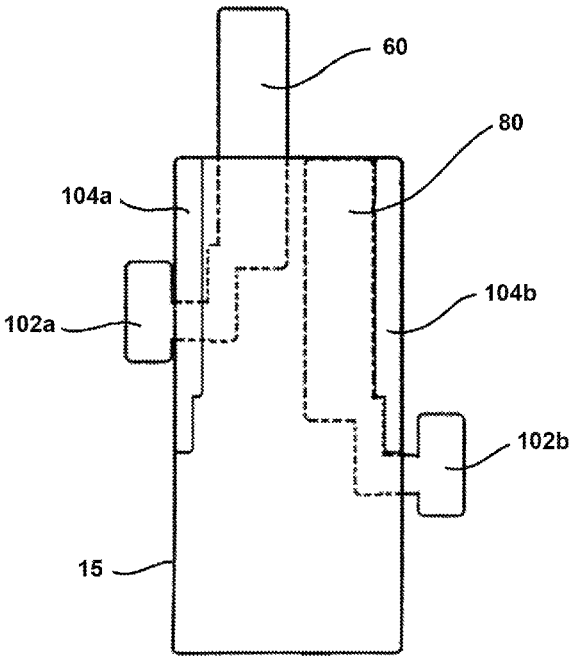
FIG. 13 shows a side view of a plug head including at least two different types of connectors.
Figure 14:
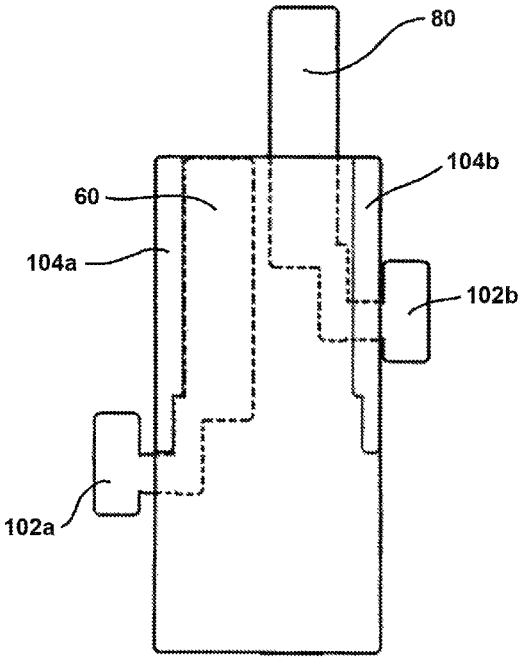
FIG. 14 shows a side view of the plug head of FIG. 13 with the connectors in a different position.

In some implementations, a plug head may be provided with two or more types of connectors within a single plug head. The connectors may be moved upwardly for use or downwardly into the plug head for storage. Thus, the connectors may be moveable between a first, stored position within the plug head, and a second, operating position. FIGS. 13 and 14 show a side view of a plug head 15 (other structures on the plug head have been omitted for clarity) with two different types of connectors within the plug head. The connectors may be, for example, a micro-USB type connector 60 and a lightning pin connector 80. Other suitable types of connectors may be used, depending on the desired usage for the cord.

The connectors may be moved upwardly into an operating position or downwardly into a stored position. This movement may be effectuated by any suitable mechanical means. For example, in FIGS. 13 and 14, each of the connectors 60, 80, is attached to a slide button 102*a,b* that extends from the side of the plug head 15. This slide button may couple with an internal structure 104*a,b* that normally biases or holds the connector into a stored position. For example, in FIG. 13, the connector 80 is held in a stored position as the slide button 102*b* couples with the internal structure 104*b*. But as the slide button 102*b* is pressed inwardly, the coupling connection is overcome, and the slide button may then be moved upwardly such that the connector 80 extends out from the plug head 15 (as shown in FIG. 14). Similarly, the connector may be moved downwardly when not in use. For example, the connector 60 in FIG. 13 may be moved downwardly by use of the slide button 102*a* until the slide button 102 couples with the internal structure 104*a* (as shown in FIG. 14).

Figure 15:
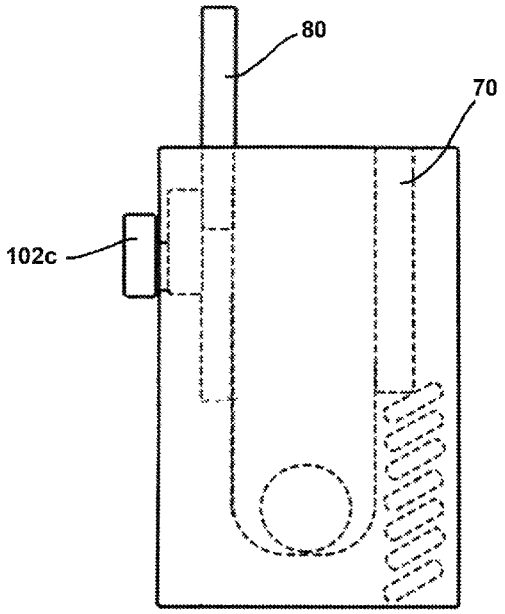
FIG. 15 shows a side view of a plug head including at least two different types of connectors.
Figure 16:
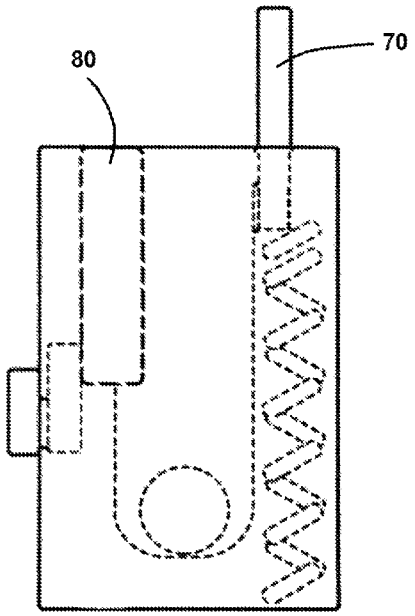
FIG. 16 shows a side view of the plug head of FIG. 15 with the connectors in a different position.

FIGS. 15 and 16 show another optional mechanical means for moving the connectors upwardly into an operating position or downwardly into a stored position. According to this implementation, a single slide button 102*c* may be provided, with the connectors 70, 80 each operated by the slide button 102*c*. (FIGS. 15 and 16 show a lightning pin type connector 80 and a USB-type connector 70 for illustrative purposes, but any known type of connector may be used according to the principles described herein). In FIGS. 15 and 16, the connectors 70, 80 are biased against each other by use of a spring and the slide button 102*c*. As shown in FIG. 15, the connector 80 is in an operating position. As the slide button 102 is pressed inwardly, the connector 80 may be slid downwardly, and as 80 moves downwardly, the connector 70 may move upwardly, into the position shown in FIG. 16.

Disclosed herein is a wrapped electrical cable comprising a first plug head and a second plug head, each of the first plug head and second plug head defining a void therethrough configured to receive a cord; a length of cable extending between the first plug head and second plug head; and the cord extending the length of the cable and passing through the void of the first plug head and the void of the second plug head. The electrical cable may further comprise a woven sheath surrounding the cord and length of cable. The cord and/or sheath may comprise paracord. In some implementations, more than one void may be defined in each of the first plug head and second plug head. The cord may be interwoven with the woven sheath. The first plug head may be at least partly formed of transparent material, and the first plug head including at least one light source. In some implementations, the second plug head may be at least partly formed of transparent material, and the second plug head including at least one light source.

In some implementations, the first plug head may include an attachment member and the second plug head may include a complementary attachment member. In other implementations, the length of cable may have a first end and a second end, the first end including a loop and the second end including an attachment member.

The electrical cable may further comprise a first cap connected to the first plug head and a second cap connected to the second plug head. The first cap may comprise an attachment member and the second cap may comprise a mating attachment member for removable attachment to the first cap. For example, a side-release buckle may be used.

A wrapped electrical cable may comprise a first plug head and a second plug head, and a cable having a length extending between the first plug head and second plug head; and a cord attached to the first plug head and second plug head, the cord having a length and wherein the length of the cord is approximately the same length as the length of the cable. The wrapped electrical cable may further comprise a woven sheath surrounding the cord and length of cable. The woven sheath may surround a portion of the first plug head and second plug head. The first plug head may define a first void and the second plug head may define a second void, and the cord may be attached to the first plug head and second plug head by the cord passing through the first void and the second void. The first plug head may include an attachment member and the second plug head may include a complementary attachment member. The attachment member may be connected to the first plug head via a pin hinge and the complementary attachment member may be attached to the second plug head via a pin hinge.

In some implementations, the length of cable may have a first end and a second end, the first end including an attachment member the second end including a complementary attachment member. The attachment member and complementary attachment member may comprise a side-release buckle. Additionally, the woven sheath may include one or more light-emitting diodes. The wrapped electrical cable may further comprise a first cap connected to the first plug head and a second cap connected to the second plug head, and wherein the first cap comprises an attachment member and the second cap comprises a mating attachment member for removable attachment to the first cap. The first plug head may be formed of at least a portion of transparent material, and may comprise a light source. The first cap may be formed at least partly of transparent material, and in some implementations include at least one light source.

Additionally disclosed herein is a type of plug head with at least two or more different types of connectors. The first plug head may include at least two different types of connectors, the connectors being moveable between a first, stored position within the first plug head, and a second, operating position.

Disclosed herein is a wrapped electrical cable comprising: a first plug head, the first plug head defining a void therethrough; a second plug head, the second plug head defining a void therethrough; a cable connected to the first plug head and second plug head, the cable extending from the first plug head to the second plug head, and wherein the cable has a length; a length of paracord extending through the void in the first plug head, along the length of cable, and through the void in the second plug head; and a woven sheath of paracord extending from the first plug head to the second plug head and substantially covering the cable and the length of paracord. The first plug head may include an attachment member and the second plug head may include a complementary attachment member.

In some implementations, a length of paracord may not be connected to the plug head. Disclosed herein is a wrapped electrical cable comprising a first plug head, the first plug head comprising a first plug head with a removably attachable cap; a second plug head, the second plug head comprising a second plug head with a removably attachable cap; a cable connected to the first plug head and second plug head, the cable extending from the first plug head to the second plug head, and a woven sheath of paracord extending from the first plug head to the second plug head.

Thus there is disclosed a wrapped electrical cable and method of use. Those skilled in the art will appreciate that there are numerous modifications which can be made without departing from the scope and spirit of the invention. The appended claims are intended to cover such modifications.

What is claimed is:

1. An electrical cable comprising:

a first plug head and a second plug head, each of the first plug head and the second plug head defining a void therethrough configured to receive a cord, wherein the first plug head includes an attachment member connected to the first plug head via a pin hinge and wherein the second plug head includes a complementary attachment member attached to the second plug head via a pin hinge;

a length of cable extending between the first plug head and second plug head; and the cord extending the length of the cable and passing through the void of the first plug head and the void of the second plug head.

2. The electrical cable of claim 1, wherein the electrical cable further comprises a woven sheath surrounding the cord and length of cable.

3. The electrical cable of claim 2, wherein the cord comprises kevlar.

4. The electrical cable of claim 1, wherein the cord comprises paracord.

5. The electrical cable of claim 1, wherein the first plug head and the second plug head define more than one void therethrough.

6. The electrical cable of claim 1, wherein the first plug head is at least partly formed of transparent material, and the first plug head including at least one light source.

7. The electrical cable of claim 1, further comprising a first cap connected to the first plug head and a second cap connected to the second plug head.

8. The electrical cable of claim 7, wherein the first cap comprises an attachment member and the second cap comprises a mating attachment member for removable attachment to the first cap.

9. A wrapped electrical cable, the wrapped electrical cable comprising:

a first plug head and a second plug head, and a cable having a length extending between the first plug head and second plug head, wherein the first plug head includes an attachment member connected to the first plug head via a pin hinge and wherein the second plug head includes a complementary attachment member attached to the second plug head via a pin hinge; and a cord attached to the first plug head and second plug head, the cord having a length and wherein the length of the cord is approximately the same length as the length of the cable.

10. The wrapped electrical cable of claim 9, wherein the electrical cable further comprises a woven sheath surrounding the cord and length of cable.

11. The wrapped electrical cable of claim 10, wherein the woven sheath surrounds a portion of the first plug head and second plug head.

12. The wrapped electrical cable of claim 9, wherein the first plug head defines a first void and the second plug head defines a second void, and wherein the cord is attached to the first plug head and second plug head by the cord passing through the first void and the second void.

13. The electrical cable of claim 9, wherein the length of cable has a first end and a second end, the first end including an attachment member the second end including a complementary attachment member.

14. The wrapped electrical cable of claim 9, wherein the first plug head is at least partly formed of transparent material and includes a light source.

15. The wrapped electrical cable of claim 14, further comprising a first cap connected to the first plug head and a second cap connected to the second plug head, and wherein the first cap comprises an attachment member and the second cap comprises a mating attachment member for removable attachment to the first cap, and wherein the first cap is formed at least partly of transparent material and includes at least one light source.

16. The wrapped electrical cable of claim 9, wherein the first plug head includes at least two different types of connectors, the connectors being moveable between a first, stored position within the first plug head, and a second, operating position.

17. An electrical cable comprising:

a first plug head and a second plug head, each of the first plug head and the second plug head defining a void therethrough configured to receive a cord, wherein the first plug head includes an attachment member connected to the first plug head via a hinge and wherein the second plug head includes a complementary attachment member attached to the second plug head via a hinge;

a length of cable extending between the first plug head and second plug head; and the cord extending the length of the cable and passing through the void of the first plug head and the void of the second plug head.

* * * * *